US009504101B2

(12) United States Patent
Zhang et al.

(10) Patent No.: US 9,504,101 B2
(45) Date of Patent: Nov. 22, 2016

(54) KALEIDOSCOPIC LIGHT STRING

(71) Applicant: GEMMY INDUSTRIES CORPORATION, Coppell, TX (US)

(72) Inventors: Cheng-Chun Zhang, Shenzhen (CN); Lio Yenwei Chang, Lewisville, TX (US)

(73) Assignee: Gemmy Industries Corp., Coppell, TX (US)

( * ) Notice: Subject to any disclaimer, the term of this patent is extended or adjusted under 35 U.S.C. 154(b) by 0 days.

(21) Appl. No.: 14/098,594

(22) Filed: Dec. 6, 2013

(65) Prior Publication Data

US 2015/0163876 A1 Jun. 11, 2015

(51) Int. Cl.

| | |
|---|---|
| ***F21V 1/00*** | (2006.01) |
| ***H05B 33/08*** | (2006.01) |
| ***F21V 5/00*** | (2015.01) |
| ***F21V 5/04*** | (2006.01) |
| *F21Y 101/00* | (2016.01) |

(52) U.S. Cl.

CPC ..... *H05B 33/0803* (2013.01); *F21S 4/20* (2016.01); *F21V 5/008* (2013.01); *F21V 5/045* (2013.01); *F21Y 2101/00* (2013.01)

(58) Field of Classification Search

CPC ... F21K 9/135; F21Y 2111/002; F21S 4/001; F21V 3/02; F21V 3/00; F21V 5/008

USPC ..... 362/249.06, 249.14

See application file for complete search history.

(56) References Cited

U.S. PATENT DOCUMENTS

| | | | | |
|---|---|---|---|---|
| 3,263,069 | A | 7/1966 | Krucki et al. | |
| 4,249,331 | A | 2/1981 | Vernon | |
| 4,870,548 | A | 9/1989 | Beachy et al. | |
| 5,688,042 | A | 11/1997 | Madadi et al. | |
| 6,474,837 | B1 | 11/2002 | Belliveau | |
| 6,786,793 | B1 | 9/2004 | Wang | |
| 7,033,037 | B2 * | 4/2006 | Chen | 362/104 |
| 7,063,553 | B1 | 6/2006 | Mullen | |
| 7,320,533 | B1 | 1/2008 | Beadle | |
| 8,262,252 | B2 | 9/2012 | Bergman et al. | |
| 2003/0231497 | A1 * | 12/2003 | Sakata et al. | 362/341 |
| 2005/0243560 | A1 | 11/2005 | Chen | |

(Continued)

OTHER PUBLICATIONS

Notice of Allowance issued Feb. 27, 2015 in U.S. Appl. No. 14/079,628.

(Continued)

*Primary Examiner* — Evan Dzierzynski

(74) *Attorney, Agent, or Firm* — Venable LLP; Steven J. Schwarz

(57) ABSTRACT

A light string can include a power cord adapted to electrically connect to an external power source, and a plurality of light bulbs electrically connected to the power cord in series. At least one of the light bulbs can include: a lamp base defining a first inner surface, and having a first beam-splitter formed on the first inner surface; a circuit board mounted in the lamp base, the circuit board electrically connected to the power cord; a plurality of light-emitting diode (LED) units electrically mounted on the circuit board; a light shade capping the lamp base, the light shade defining a second inner surface and having a second beam-splitter formed on the second inner surface, wherein the first beam-splitter and second beam-splitter are contiguous; and a refractive lens mounted in the lamp base between the LED units and the first beam splitter.

14 Claims, 4 Drawing Sheets

(56) References Cited

U.S. PATENT DOCUMENTS

| | | | | |
|---|---|---|---|---|
| 2007/0097681 | A1 | 5/2007 | Chich et al. | |
| 2009/0122548 | A1 | 5/2009 | Dalsgaard | |
| 2009/0268466 | A1 | 10/2009 | Allegri | |
| 2010/0091491 | A1* | 4/2010 | Jiang et al. | 362/235 |
| 2011/0194292 | A1* | 8/2011 | Tsai | 362/311.02 |
| 2011/0286200 | A1* | 11/2011 | Iimura et al. | 362/84 |
| 2012/0147609 | A1 | 6/2012 | Black et al. | |
| 2012/0182743 | A1 | 7/2012 | Chou | |
| 2012/0300429 | A1* | 11/2012 | Jin | 362/84 |
| 2013/0094193 | A1 | 4/2013 | Baxter et al. | |
| 2014/0001507 | A1 | 1/2014 | Streppel et al. | |

OTHER PUBLICATIONS

Office Action issued Feb. 26, 2015 in U.S. Appl. No. 14/145,512.
Office Action issued Nov. 13, 2015 in U.S. Appl. No. 14/145,512.

* cited by examiner

KALEIDOSCOPIC LIGHT STRING

BACKGROUND OF THE INVENTION

1. Field of the Invention

The present invention relates to a light string, especially to a kaleidoscopic light string that generates kaleidoscopic lighting variations.

2. Description of the Prior Art(s)

A conventional light string comprises multiple light bulbs. The light bulbs are serially connected by a power cord. The power cord is electrically connected to a plug. Each of the light bulbs has a lamp base, a lighting module, and a light shade. The lighting module is mounted in the lamp base, is electrically connected to the power cord, and has multiple light-emitting components. The light shade caps the lamp base.

The conventional light string is wound around articles for decoration, such as Christmas trees, dolls, or the like. The plug is connected to an external power source to provide electrical power to the lighting module. Thus, the light-emitting components of the lighting module emit light. Moreover, the light-emitting components can blink so as to generate lighting variations of the light string. However, since the light-emitting components can only provide an on-and-off lighting effect by blinking, the lighting is monotonous and a decorative effect of the conventional light string cannot be improved.

To overcome the shortcomings, the present invention provides a kaleidoscopic light string to mitigate or obviate the aforementioned problems.

SUMMARY OF THE INVENTION

Embodiments of the present invention provide a kaleidoscopic light string. Embodiments of the kaleidoscopic light string have a power cord and multiple light bulbs electrically and serially connected by the power cord. Each of the light bulbs has a lamp base with a first beam-splitter lens portion, a circuit board with a control unit, multiple light-emitting diode (LED) units, a refractive lens, and a light shade. The circuit board is mounted in the lamp base. The LED units are electrically mounted on the circuit board. The refractive lens is disposed in front of the distal ends of the LED units and is surrounded by the first beam-splitter lens portion of the lamp base. The light shade caps the lamp base and has a second beam-splitter lens portion being contiguous to the first beam-splitter lens portion of the lamp base.

Embodiments of the LED units are controlled by the control unit so as to form marquee lighting effects. Light beams that are emitted from the LED units project through and are mixed by the refractive lens. Then the mixed light beams further project through the first beam-splitter lens portion and the second beam-splitter lens portion to project outwards at different angles covering a large area to provide different kinds of lighting variations and to have improved entertaining and decorative effects.

Other objectives, advantages and novel features of the invention will become more apparent from the following detailed description when taken in conjunction with the accompanying drawings.

DETAILED DESCRIPTION

Figure 1:
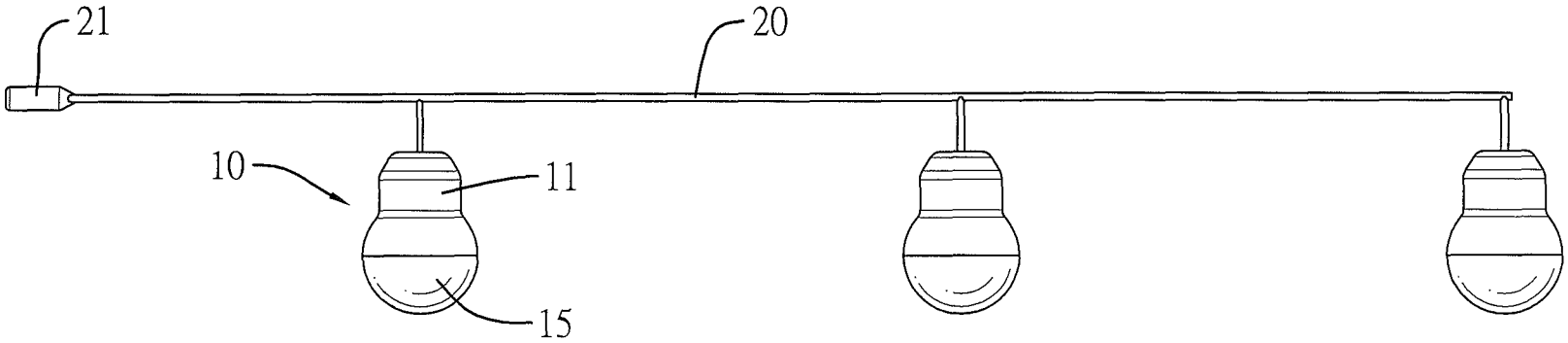
FIG. 1 is a front view of a kaleidoscopic light string in accordance with an embodiment of the present invention.

With reference to FIG. 1, a kaleidoscopic light string in accordance with an embodiment of the present invention comprises a power cord 20 and multiple light bulbs 10.

The power cord 20 is electrically connected to a plug 21. The plug 21 is used to be connected to an external power source.

Figure 2:
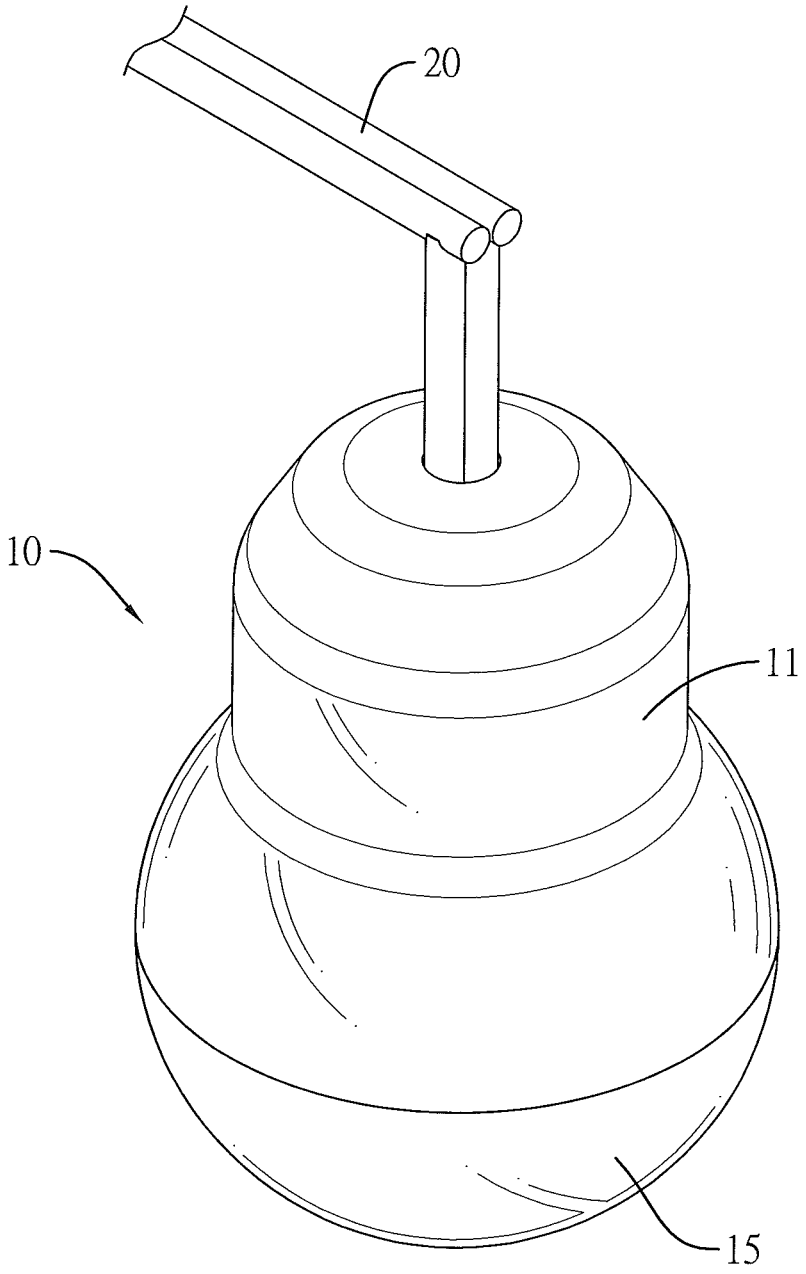
FIG. 2 is an enlarged perspective view of an embodiment of a light bulb of the kaleidoscopic light string in FIG. 1.
Figure 3:
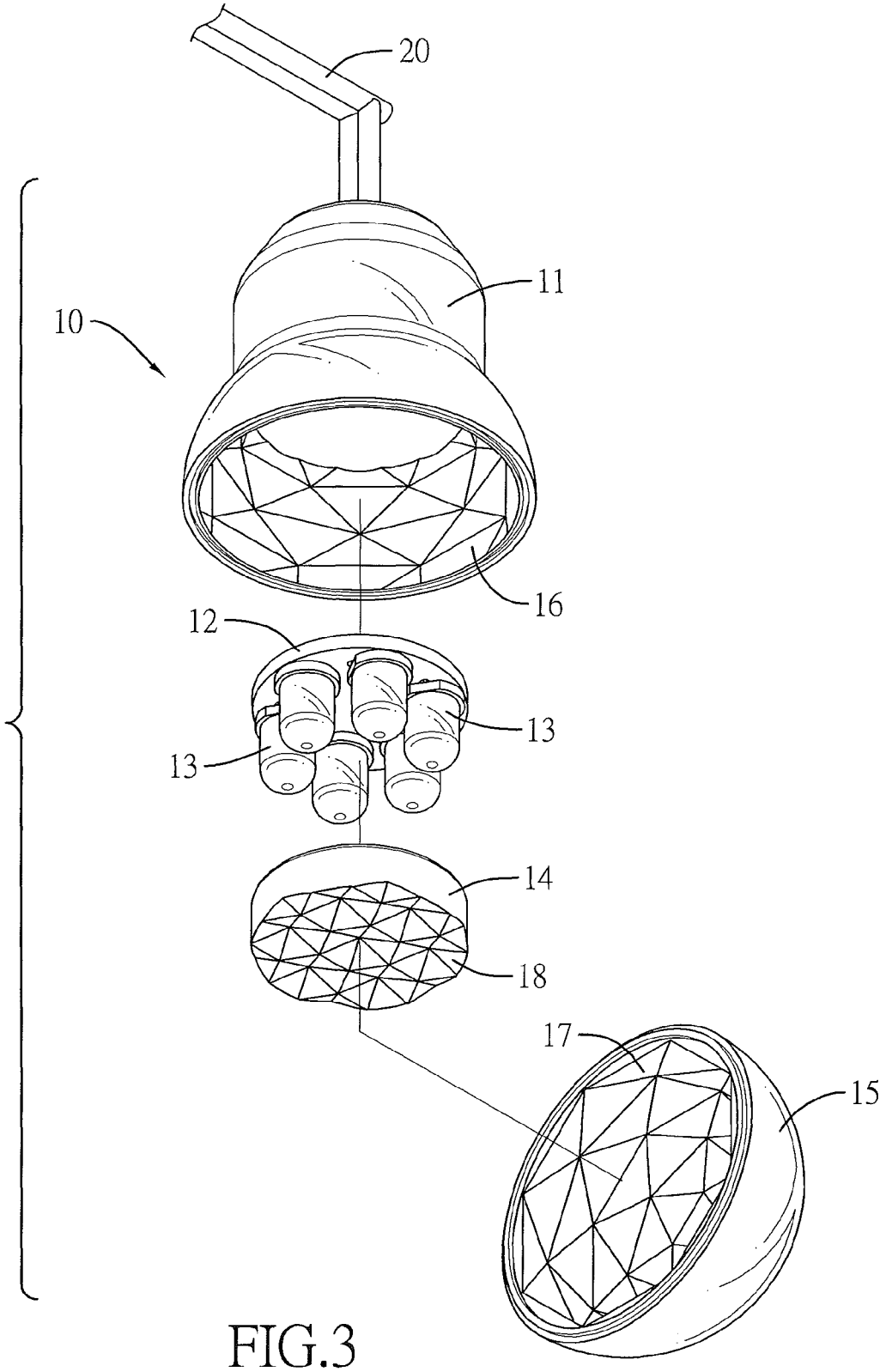
FIG. 3 is an exploded perspective view of an embodiment of the light bulb of the kaleidoscopic light string in FIG. 1.

With further reference to FIGS. 2 and 3, the light bulbs 10 are electrically and serially connected by the power cord 20. Each of the light bulbs 10 has a lamp base 11, a circuit board 12, multiple light-emitting diode (LED) units 13, a refractive lens 14, and a light shade 15.

Figure 4:
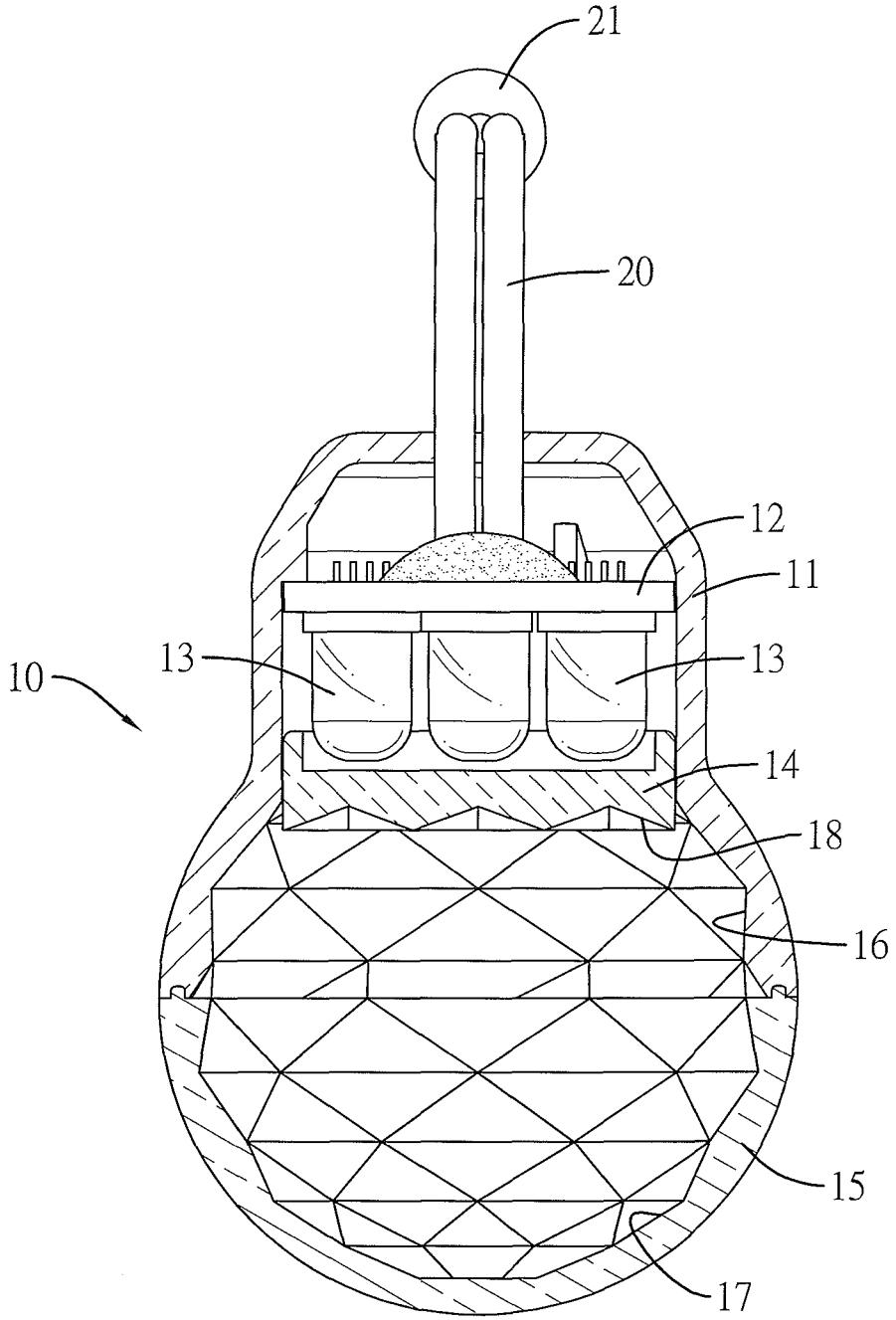
FIG. 4 is a side view in partial section of an embodiment of the light bulb of the kaleidoscopic light string in FIG. 1.

With further reference to FIG. 4, the lamp base 11 has a front open end, an inner surface, and a first beam-splitter lens portion 16. The first beam-splitter lens portion 16 is formed on the inner surface of the lamp base 11, is disposed around the front open end of the lamp base 11, and includes multiple convex lens units.

The circuit board 12 is mounted in the lamp base 11, is electrically connected to the power cord 20, and has a control unit. A model number of the control unit may be NY5C185A.

The LED units 13 are electrically mounted on the circuit board 12 and are controlled by the control unit of the circuit board 12. Each of the LED units 13 may be a three-color LED unit that selectively emits light beams in different colors, such as blue, red, green, and so on. Each of the LED units 13 has a distal end. The distal end of the LED unit 13 protrudes toward the front open end of the lamp base 11. The control unit of the circuit board 12 controls blinking of the LED units 16 and the colors of the light beams of the LED units 13, so as to form marquee lighting effects with the blue light beams, red light beams, or the green light beams. Moreover, the LED units 13 may be circularly arranged and may be grouped into two, three, four, five, six, or more groups.

The refractive lens 14 is mounted in the lamp base 11, is disposed in front of the distal ends of the LED units 13, and is surrounded by the first beam-splitter lens portion 16 of the lamp base 11. The refractive lens 14 has a front surface. The front surface of the refractive lens 14 is irregular and rough, and has multiple refractive faces being planar and inclining at different angles.

The light shade 15 caps the lamp base 11, is mounted on the front open end of the lamp base 11 and has an inner surface and a second beam-splitter lens portion 17. The second beam-splitter lens portion 17 is formed on the inner surface of the light shade 15, faces the front surface of the refractive lens 14, is contiguous to the first beam-splitter lens portion 16 of the lamp base 11, and includes multiple convex lens units.

The kaleidoscopic light string as described may be used in a ground inserted projection light, a suspended stage light, a street light, inflatable clothes, or an inflatable display in shape of a cartoon character or doll.

When the power cord 20 of the kaleidoscopic light string is connected to the external power source to provide electrical power to the circuit board 12 and the LED units 13, the LED units 13 that are controlled by the control unit of the circuit board 12 sequentially emit the red light beams, the blue light beams, and then the green light beams so as to form the marquee lighting effects. As the light beams of the LED units 13 project through the refractive lens 14, the light beams in different colors are mixed and then further project through the first beam-splitter lens portion 16 and the second beam-splitter lens portion 17. With the convex lens units of the first beam-splitter lens portion 16 and the second beam-splitter lens portion 17, the light beams that are refracted by the first and the second beam-splitter lens portions 16, 17 can project outwards at different angles covering a large area to form kaleidoscopic lighting variations. Furthermore, depending on shapes and locations of the first and the second beam-splitter lens portions 16, 17, different kaleidoscopic lighting variations can be formed. Therefore, the kaleidoscopic light string as described provides different kinds of lighting variations and has improved entertaining and decorative effects.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A light string, comprising:

a power cord adapted to electrically connect to an external power source; and a plurality of light bulbs electrically connected to the power cord in series, at least one of the light bulbs comprising:

a lamp base defining a first inner surface, and having a first beam-splitter formed on the first inner surface;

a circuit board mounted in the lamp base, the circuit board electrically connected to the power cord;

a plurality of light-emitting diode (LED) units electrically mounted on the circuit board;

a light shade capping the lamp base, the light shade defining a second inner surface, and having a second beam-splitter formed on the second inner surface, wherein the first beam-splitter and second beam-splitter are directed toward one another and are contiguous; and a refractive lens mounted in the lamp base between the LED units and the first beam splitter;

wherein the refractive lens defines a front surface facing away from the LED units and toward the second beam-splitter, the front surface having multiple refractive faces.

2. The light string of claim 1, wherein the circuit board includes a control unit adapted to control the plurality of LED units.

3. The light string of claim 2, wherein the control unit is adapted to control the LED units to generate kaleidoscopic lighting effects.

4. The light string of claim 2, wherein the control unit is adapted to control the LED units to sequentially emit different color light beams.

5. The light string of claim 1, wherein each of the LED units comprises a three-color LED unit.

6. The light string of claim 5, wherein each of the LED units comprises a RGB LED unit.

7. The light string of claim 1, wherein the LED units are arranged in circles.

8. The light string of claim 1, wherein the first beam-splitter comprises a plurality of convex lenses arranged at different angles.

9. The light string of claim 1, wherein the second beam-splitter comprises a plurality of convex lenses arranged at different angles.

10. The light string of claim 1, wherein:

the first beam-splitter comprises a plurality of convex lenses; and the second beam-splitter comprises a plurality of convex lenses.

11. The light string of claim 1, wherein the refractive lens mixes light beams emitted by the LED units.

12. The light string of claim 1, wherein the LED units are arranged into groups of LED units arranged in circles.

13. The light string of claim 12, wherein the LED units comprise multi-color LED units.

14. The light string of claim 13, wherein the circuit board includes a control unit adapted to control the plurality of LED units to sequentially emit different color light beams.

* * * * *